US006398912B1

(12) United States Patent
Vihervaara et al.

(10) Patent No.: US 6,398,912 B1
(45) Date of Patent: Jun. 4, 2002

(54) ADDITIVE FOR PAPER MAKING

(75) Inventors: Tapio Vihervaara, Turku; Kari Luukkonen; Veikko Niinivaara, both of Raisio, all of (FI)

(73) Assignee: Raisio Chemicals Ltd., Raisio (FI)

( * ) Notice: Subject to any disclaimer, the term of this patent is extended or adjusted under 35 U.S.C. 154(b) by 0 days.

(21) Appl. No.: 09/743,355

(22) PCT Filed: Jul. 7, 1999

(86) PCT No.: PCT/FI99/00601

§ 371 (c)(1),
(2), (4) Date: Jan. 9, 2001

(87) PCT Pub. No.: WO00/03090

PCT Pub. Date: Jan. 20, 2001

(30) Foreign Application Priority Data

Jul. 10, 1998 (FI) ..... 981586
Feb. 5, 1999 (FI) ..... 990227

(51) Int. Cl.[7] ..... D21H 17/25

(52) U.S. Cl. ..... 162/175; 106/208.1; 106/214.1; 536/45; 536/105

(58) Field of Search ..... 162/157.1, 157.2, 162/157.4, 157.5, 158, 164.1, 164.6, 168.1, 168.2, 168.3, 173, 175, 176, 177, 183, 184, 185; 106/206.1, 214.1; 127/32, 33, 70; 525/54.24; 527/300, 312; 536/45, 102, 105

(56) References Cited

U.S. PATENT DOCUMENTS 4,373,099 A * 2/1983 Hubbard et al. ..... 536/105
6,210,475 B1 * 4/2001 Dauplaise et al. ..... 106/209.1
6,235,835 B1 * 5/2001 Niessner et al. ..... 525/54.24

FOREIGN PATENT DOCUMENTS

EP 0 257 338 3/1988 ..... C08B/31/16
WO WO 93/10305 5/1993 ..... D21F/1/66
WO WO 97/46591 12/1997 ..... C08B/31/12
WO 98-24972 * 6/1998 ..... D21H/17/74

* cited by examiner

*Primary Examiner*—Peter Chin
*Assistant Examiner*—Eric Hug
(74) *Attorney, Agent, or Firm*—Connolly Bove Lodge & Hutz LLP

(57) ABSTRACT

The object of the invention is an additive for paper making by means of which the dusting tendency of paper can be reduced. The agent is based on starch, the molecular size of which has been reduced, and which has been cationized to a charge of less than 1.5 mEkv/g with a quaternary nitrogen compound. The agent is added to the fiber pulp for paper making prior to web formation.

13 Claims, 2 Drawing Sheets

ADDITIVE FOR PAPER MAKING

Figure 1:
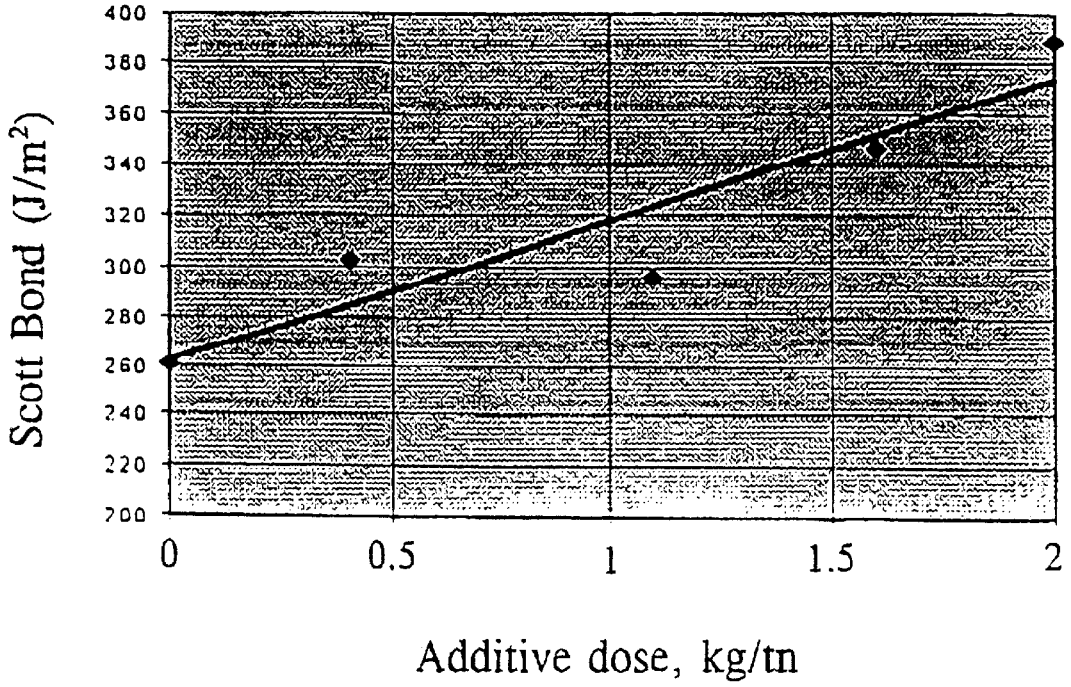

The present invention concerns an additive for paper making, which is added to the fiber pulp prior to the web formation step in a paper making process. By means of the additive it is possible to impart to the paper i.a. a reduced tendency for dusting. In addition, the additive has been shown to facilitate water removal in the web formation stage, to improve filler retention, and to affect advantageously the removal of harmful substances, which have accumulated in the water circulation system of the paper machine. The additive also increases the strength of the finished paper, both dry strength and wet strength. By using the additive for paper making according to the invention improvements have been seen also in the printability of the paper, i.a. as regards its applicability for ink-jet printing.

A problem that is encountered in finished paper is its high tendency for dust formation, the reason for which are fiber particles and filler particles released from the paper surface. The dust gives rise to problems already at the drying stage in paper making, but above all in the machines and equipments handling paper, such as in printing equipment. The printing methods as such are developed which means high machine speeds and long printing series. High speeds aggrevate dust formation, and long printing series reduce standing times, during which it would be possible to carry out a cleaning of the equipments.

In order to solve the dusting problem it is known to use methods, which as a rule are based on chemical compounds to be added to the fiber pulp, prior to the paper web formation. The use of mineral and micro waxes, of sizing agents, such as AKD and ASA dispersions, of wet strength resins and of pulp sizing starch is known. Irrespective of these known measures, paper dusting is still a significant problem.

Now it has surprisingly been discovered that i.a. the dusting of paper can be reduced significantly by means of the additive according to the invention to be added to the fiber pulp prior to web formation.

The additive is based on starch, which has been modified to be applicable in the invention by reducing its molecular size and reacted with an appropriate nitrogen compound in order to provide a suitable cationic charge level to the starch.

The reduction of the molecular size has been carried out advantageously by oxidizing, such as by peroxide oxidation. The reduction of the molecular size is appropriately carried out so that the viscosity of a 5% starch suspension at 60° C. is in the range 10–400 mPas (Brookfield). The viscosity is advantageously 100–400 mPas, and especially advantageously in the range 100–200 mPas. This is achieved for example using a hydrogen peroxide dose of approximately 0.02–0.3% from the starch dry matter in slightly alkaline reaction conditions. The desired degree of degradation is also bound to the desired cationic charge of the end product, since an increase in the cationic charge decreases the viscosity of the end product. There is also interdependence between the molecular size and the cationic charge which affects the behaviour of the starch in the paper machine.

Starch which has been processed to have the desired viscosity level is thereafter processed with a quaternary nitrogen compound according to the invention so that its cationic charge level will be in the range <1.5, preferably in the range 0.36–1.46, especially advantageously in the range 0.72–1.10 mEqv/g, whereby the nitrogen contents when using,the quaternary cationizing chemical, will be in the range 0.5–2.5, correspondingly 1.0–1.5%. The product is advantageously prepared using solution cationization, in which the starch is fed into the cationization process in granular form, the process conditions are chosen so that the starch dissolves completely during the process. Essential process quantities in this respect are the concentration of the starch to be cationized, suitable alkalinity and increased temperature. The alkali dose (NaOH) is suitably in the range of approximately 1.5–3% of the starch dry matter, and the temperature suitably in the range of approximately 60–80° C. The dry matter content of the reaction mixture should advantageously be over 50%, which gives i.a. a good yield for the end product. A suitable quaternary cationizing chemical is 2,3-epoxypropyltrimethylammonium chloride, which should be used in an amount of approximately 10–40% of the amount of starch.

The applicability of the invention is illustrated with the following examples, in which i.a. paper properties, which have an effect on the dusting of the paper in different paper handling conditions, have been monitored. Measuring the dusting tendency from a paper is as such problematic without a prolonged run of the paper in an application process, such as a printing operation. It is, however, generally known that the tendency for dust formation correlates to strength parameters which can be measured from the paper, such as Dennison, IGT and Scott Bond.

EXAMPLE 1

In this example the test was carried out under full-scale practical printing conditions using a paper fabricated on a newspaper machine. On the newspaper machine which had a capacity of 700 tons/24 hours a paper was made from a pulp of pressure groundwood and thermomechanical pulp. Before web formation, a starch based chemical according to the invention was mixed to the pulp in the pulp mixer on the suction side of the pump in a dose of 1.5–2.5 kg/ton. Paper made in this way was then printed in a printing house, whereby it could be established that the time between cleaning of the printing rollers increased from 80000 copies to 350000 copies. The used additive had been manufactured so that starch which had been oxidatively degraded to a usable viscosity level (100–200 mPas, 5%, 60° C., Brookfield), had been cationized with 2,3-epoxypropyltrimethylammonium chloride using this cationizing chemical in an amount of 25% of the starch dry matter. The nitrogen content of the starch was 1.5 % (charge 1.07 mEqv/g). From the paper also the Scott Bond value which indicates the interlaminar strength (bonding strength) was measured as one characteristic. These values have been given as a function of the additive dose in the appended FIG. 1. When comparing to dust measurements carried out it could be established that the Scott Bond value of the paper clearly correlated to the dusting and printability properties.

EXAMPLE 2

A test series was carried out on a newspaper machine having a capacity of appr. 800 tons/24 hours. The composition of the pulp used for the paper was 50/50 TMP/DIP (thermomechanical/deinked). The test run lasted for 24 hours, during which time the change in strength values was monitored for different amounts of additives. The used additive had been manufactured so that the starch which had been oxidatively degraded to a viscosity level of approximately 200 mPas (5 %, 60° C., Brookfield) was cationized with 2,3-epoxypropyltrimethylammonium chloride using this cationizing chemical in an amount of 15% of the amount of starch. The nitrogen content of the starch was 1.0% (charge 0.72 mEqv/g).

The results are given in the following table I.

| Additive dose, kg/t | Scott Bond $J/m^2$ | Dennison | IGT m/s | Burst $kPam^2/g$ |
|---|---|---|---|---|
| 1. 0 | 198.6 | 7.0 | 1.36 | 1.38 |
| 2. 0 | 190.6 | 7.0 | 1.30 | 1.45 |
| 3. 1 | 195.4 | 8.0 | 1.77 | 1.47 |
| 4. 1.4 | 205.9 | 7.0 | 1.95 | 1.42 |
| 5. 1.8 | 194.0 | 9.0 | 1.33 | 1.51 |
| 6. 1.4 | 297.6 | 9.0 | 1.26 | 1.44 |
| 7. 3 | 238.3 | 9.5 | 1.53 | 1.47 |
| 8. 3 | 304.3 | 10.0 | 1.56 | 1.41 |
| 9. 3 | 299.9 | 9.5 | 1.57 | 1.52 |
| 10. 3 | 213.5 | 9.0 | 1.22 | 1.50 |
| 11. 3 | 227.4 | 9.0 | 1.50 | 1.48 |
| 12. 3 | 225.6 | 9.0 | 1.59 | 1.48 |
| 13. 3 | 207.6 | 9.0 | 1.60 | 1.56 |
| 14. 3 | 241.1 | 9.0 | 1.49 | 1.52 |
| 15. 3.5 | 280.1 | 9.0 | 1.57 | 1.49 |
| 16. 4 | 260.6 | 9.0 | 1.36 | 1.53 |
| 17. 0 | 246.9 | 8.0 | 1.26 | 1.42 |
| 18. 0 | 212.8 | 8.0 | 1.18 | 1.41 |

From the results it can be seen that it is possible to affect the strength properties which in turn affect the dusting properties of the paper by means of the product according to the invention.

EXAMPLE 3

Figure 2:
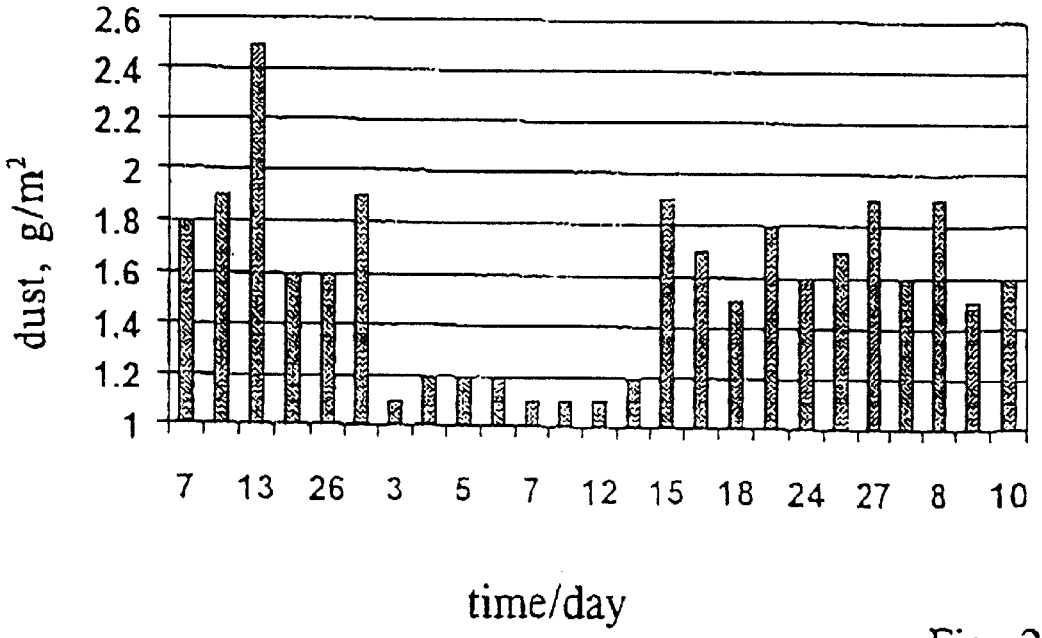

A test run lasting for 2 weeks was carried out on a newspaper machine which had a capacity of 400 tons/24 hours. For the paper raw material, peroxide bleached pressure groundwood was used. To the pulp conventional pulp starch was added in an amount of 10–13 kg/ton for the whole test run. A period of 12 days (the test days 3 to 14) was included in the test run, during which time an additive according to the invention was added to the pulp prior to web formation, in an amount of 2.5 kg/ton, in addition to the conventional pulp starch, the additive having been prepared in a manner similar to the additive of example 1. From the paper, printing series of 4000 sheets each from a paper sample taken each day was run in a test printer, from which printing series the dust amount was measured. The test results have been presented as a bar diagram in the appended FIG. 2. The results show a clear decrease in the amount of dust irrespective of the fact that a conventional internal size was present in the paper manufacture, which for its part should participate in reducing dusting.

EXAMPLE 4

A test run was carried out on a newspaper machine by running newsprint (30–40 $g/m^2$) the fiber base of which was pressure groundwood, thermomechanical pulp, chemical pulp and deinked pulp. The machine was operated at an acid pH-range. A bentonite/PAM microparticle retention system was used as the retention system. An additive according to the example 1 was fed to the mixing container on the suction side of the pump in an amount of 1,0 kg/ton.

Figure 3:
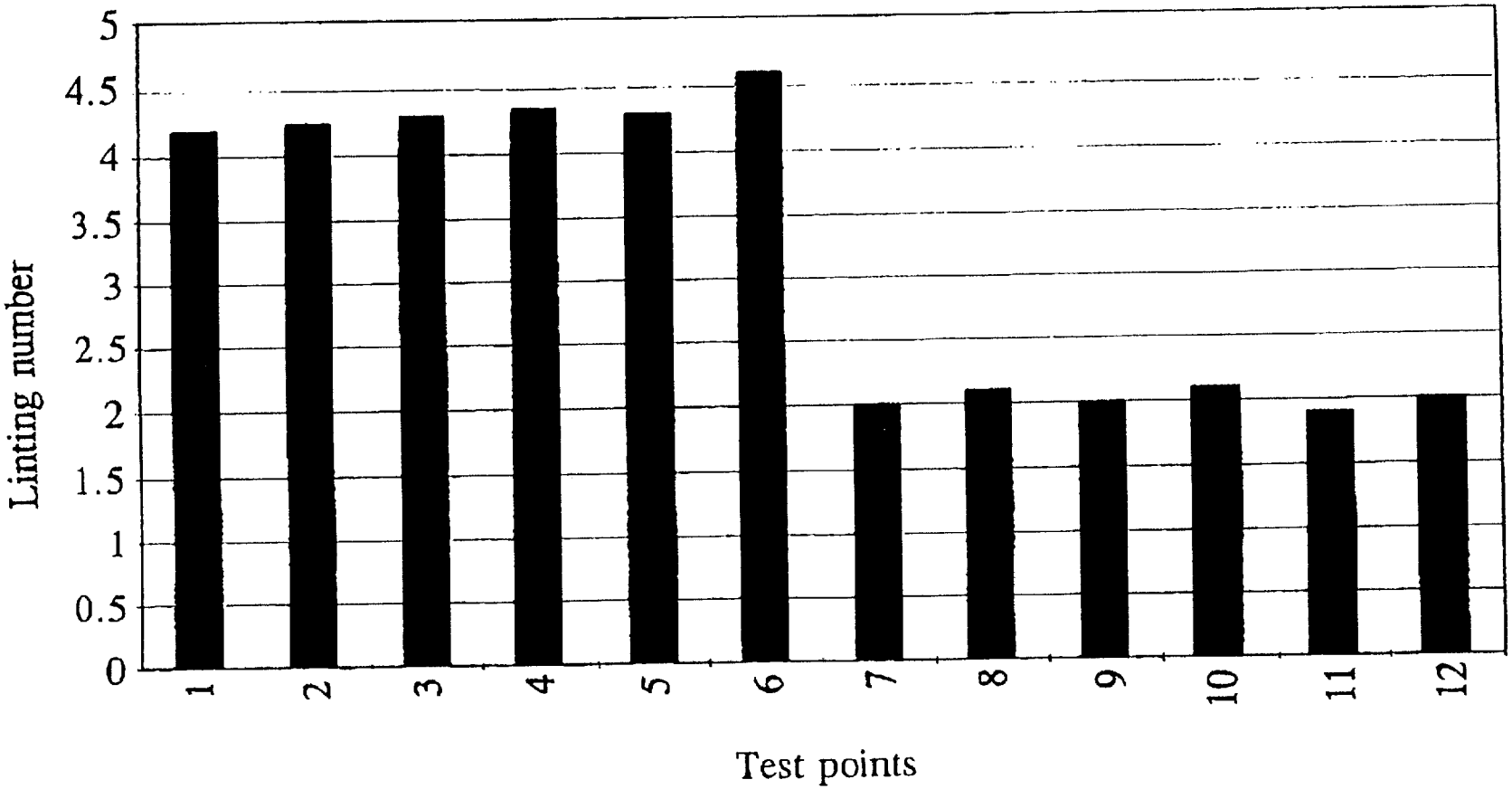

The behaviour of the finished paper was monitored on-line with a dust measuring device (MB Linting Dusting Tester). The results are given in the appended FIG. 3. It could be seen that the dusting had decreased 50–60% (test points 7–12) as compared to a corresponding paper without the additive according to the invention (test points 1–6).

Differences could be seen also in the operation of the paper machine as compared to manufacturing a corresponding paper without the additive according to the invention, i.a. water drainage improved, which manifested itself as a reduction in the steam requirement in the drying section. Also an advantageous effect as regards to retention could be seen which resulted in a decrease of approximately 50% in the retention aid (PAM, polyacrylmide).

What is claimed is:

1. A paper strengthener additive for paper making to be added to the fiber pulp prior to web formation, which additive has been made from starch which to its molecular weight has been thinned to a viscosity level of 10–500 mpas (5%, 60° C., Brookfield), and solution canonized in a solution having a dry matter content over 50% with a quaternary nitrogen compound to a charge level of 0.36–1.46 mEq/g.

2. The additive according to claim 1 where the starch has a charge level of 0.72–1.10 mEq/g (1–1.54% N).

3. The additive according to claim 1, where the starch to its molecular weight has been thinned to a viscosity level of 100–200 mPas (5%, 60° C., Brookfield).

4. The additive according to claim 2, where the starch to its molecular weight has been thinned to a viscosity level of 100–200 mPas (5% 60° C., Brookfield).

5. The additive according to claim 1, where the starch has been thinned by oxidation.

6. The additive according to claim 5, where the starch has been thinned by peroxide oxidation.

7. The additive according to claim 2, where the starch has been thinned by oxidation.

8. The additive according to claim 3, where the starch has been thinned by oxidation.

9. A method for decreasing the dusting of paper by adding to the fiber pulp fed to web formation, where an additive according to claim 1 is added to the fiber pulp.

10. The method according to claim 9, where the additive is added in an amount of 1.0–3.0 kg/ton.

11. The method, where, in addition to the additive of claim 1, conventional stock starch is added to the fiber pulp.

12. A paper manufacture process for decreasing the dusting tendency of the paper manufactured, the process comprising web formation from fiber suspension, wherein the additive of claim 1 is added to the fiber suspension.

13. The process according to claim 12, wherein the additive is added to the fiber suspension in an amount of 1.0–3.0 kg/ton.

* * * * *